US007661478B2

(12) United States Patent
Palmer et al.

(10) Patent No.: US 7,661,478 B2
(45) Date of Patent: Feb. 16, 2010

(54) BALL DROP CIRCULATION VALVE

(75) Inventors: Larry T. Palmer, Spring, TX (US); John M. Sprott, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 157 days.

(21) Appl. No.: 11/583,678

(22) Filed: Oct. 19, 2006

(65) Prior Publication Data

US 2008/0093080 A1 Apr. 24, 2008

(51) Int. Cl.
*E21B 33/00* (2006.01)
*E21B 23/10* (2006.01)

(52) U.S. Cl. ..... 166/318; 166/154; 166/332.4; 166/332.5; 166/386

(58) Field of Classification Search ..... 166/318, 166/154, 332.4, 332.5, 386
See application file for complete search history.

(56) References Cited

U.S. PATENT DOCUMENTS 3,364,999 A * 1/1968 Brown et al. ..... 166/327
3,703,193 A * 11/1972 Raulins ..... 137/630
4,322,267 A * 3/1982 Kinoshita et al. ..... 376/216
4,522,266 A * 6/1985 Barrington ..... 166/321
5,462,121 A * 10/1995 Schmuck et al. ..... 166/383
5,901,796 A * 5/1999 McDonald ..... 175/57
5,960,881 A * 10/1999 Allamon et al. ..... 166/291
6,155,350 A * 12/2000 Melenyzer ..... 166/374
6,401,822 B1 * 6/2002 Baugh ..... 166/319
6,467,546 B2 * 10/2002 Allamon et al. ..... 166/381
7,322,417 B2 * 1/2008 Rytlewski et al. ..... 166/313
2006/0213670 A1 * 9/2006 Bishop et al. ..... 166/386
2006/0243455 A1 * 11/2006 Telfer et al. ..... 166/386

OTHER PUBLICATIONS

Baker Hughes, Baker Oil Tools, Conventional Fishing Technical Unit; Pump Out Sub Product Family No. H14061, Jun. 7, 2005, 1 page.
Hoffman, C.R., "One-Trip Sand-Control / Liner Hanger / Big-Bore Completion System", SPE 101086, Sep. 2006, 1-10.
Boscan, Jorge, et al., "Successful Well Testing Operations in High-Pressuer/High-Remperature Environment: Case Histories", SPE 84096, Oct. 2003, 1-15.
Ross, Colby M., et al, "Current Materials and Devices for Control of Fluid Loss", SPE 54323, Apr. 1999, 1-16.

* cited by examiner

*Primary Examiner*—Jennifer H Gay
*Assistant Examiner*—Yong-Suk Ro
(74) *Attorney, Agent, or Firm*—Steve Rosenblatt

(57) ABSTRACT

A downhole tool can perform a series of operations with balls of the same size where movement caused by pressuring up on the first ball positions the next seat to accept another ball just like it. In a preferred embodiment a circulation sub is run in with a port closed and a first seat comprising of collets pushed together and preferably lined with a sleeve are in position to accept a first ball to perform a downhole operation and thereafter pass the ball and open the port. The act of opening the port gives support, by reducing their dimension, to the next assembly of collets also preferably lined with a sleeve so that they are energized to accept the same size ball. Pressuring up on the second ball can shift another sleeve to close the circulation port. The tool is modular and more than one module can be deployed in a given bottom hole assembly.

20 Claims, 1 Drawing Sheet

BALL DROP CIRCULATION VALVE

FIELD OF THE INVENTION

The field of this invention is downhole circulation valves that can be opened and closed with dropped balls and more particularly to valves that can open and close without having to use a larger ball for a second position of the valve.

BACKGROUND OF THE INVENTION

There are many operations downhole that require circulation or reverse circulation through a tool string. Almost as often the circulation valve needs to be operated between two positions so that, for example, it can be run in open to the desired location and then after the circulation is done, it can be closed again.

There are many types of circulation valves that are in use downhole. Some have an internal ported sleeve that is attached to a housing with a port through a j-slot mechanism. With this type of valve picking up and setting down weight gets the ports aligned or misaligned, as needed. These types of valves are less suitable for deviated wellbores where it is difficult to know if picking up and setting down has actually shifted the circulation valve or merely stretched the tubing string from a location near a wellbore deviation.

Other types of circulation valves involve the use of ever larger balls to move a circulation valve between its end positions. This design allows an initial smaller ball to land on a seat to pressure up to set another tool followed by a further pressure to move the valve to another position. In order to move the valve again to its initial position a bigger ball has to land on a bigger seat to, for example, shift a different sleeve. The initial ball is typically released as its seat shifts into a recess and opens up. Such seats can be made of collet segments that are held together in an initial position to allow pressure buildup on a seated ball and then the collet fingers in a groove can spread apart allowing the ball to go on through.

As an alternative, a different seat has been employed that simply enlarges as the ball is blown though it with pressure. It then stands ready to receive another ball that is larger for another operation.

A circulation valve with disappearing balls has been offered. The idea here is to use a seat that keeps its dimension so that it can accept a constant ball size. The idea is that the ball lands on the seat and permits whatever operation is needed and then just goes away from exposure to well conditions over time. The problem with this design is that the balls are rather soft and are prone to be eroded during delivery or even when on the ball seat itself and before the operation that depends on the ball sealing can be accomplished.

Other issues that have affected ball seats made of a series of collets is that the sealing happens on a series of abutting shoulders and in a downhole environment where debris can settle on the seating surface and reduce the chance for a good seal on the ball.

The present invention seeks to overcome some of these disadvantages. While the invention is presented in the context of a circulation valve it can be deployed in other applications downhole. These and other advantages of the present invention will become more apparent to those skilled in the art from a review of the preferred embodiment described below along with its associated drawings while recognizing that the claims define the full scope of the invention.

SUMMARY OF THE INVENTION

A downhole tool can perform a series of operations with balls of the same size where movement caused by pressuring up on the first ball positions the next seat to accept another ball just like it. In a preferred embodiment a circulation sub is run in with a port closed and a first seat comprising of collets pushed together and preferably lined with a sleeve are in position to accept a first ball to perform a downhole operation and thereafter pass the ball and open the port. The act of opening the port gives support, by reducing their dimension, to the next assembly of collets also preferably lined with a sleeve so that they are energized to accept the same size ball. Pressuring up on the second ball can shift another sleeve to close the circulation port. The tool is modular and more than one module can be deployed in a given bottom hole assembly.

DETAILED DESCRIPTION OF THE PREFERRED EMBODIMENT

Figure 1:
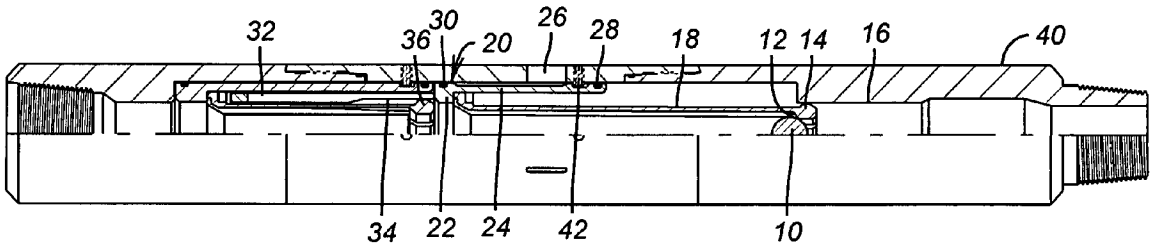
FIG. 1 is a section view of the tool with a seated first ball and the circulation port closed.
Figure 2:
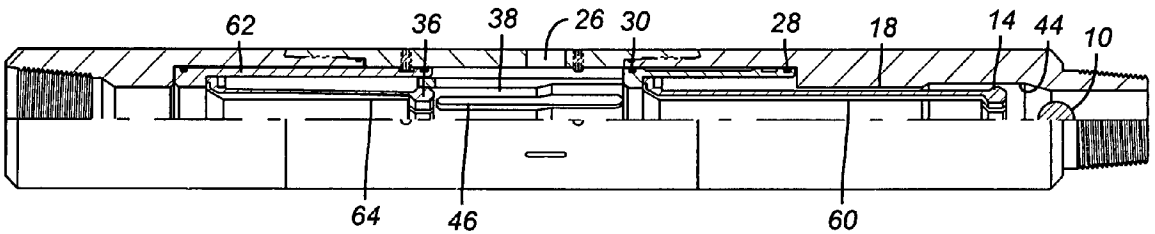
FIG. 2 is the view of FIG. 1 with the first ball released, the port open and the second seat now supported to accept a second ball as big as the first.

FIG. 1 illustrates the position of one module of the present invention after run in and the dropping of a ball 10 to land on a seat 12. Seat 12 is formed of a series of abutting collet heads 14 that are supported in bore 16. The collet heads 14 are mounted to a series of collet fingers 18 that extend from piston 20. Piston 20 comprises a ring 22 with a solid sleeve 24 extending down from it. In the run in position, a flow port 26 is covered by sleeve 24 and is closed because seals 28 and 30 straddle port 26. An upper segment 32 is connected to ring 22 for tandem movement. It has a larger internal diameter 34 that is initially opposed to collet heads 36 in a manner that preferably gives them no support so that ball 10 can readily pass through collet heads 36 in the FIG. 1 configuration without getting hung up. Upper segment 32 has a reduced diameter 38 shown in FIG. 2 that can come into position behind the collet heads 36 to give them full support, as will be described later.

Sleeve 24 is initially secured to the housing 40 by a shear pin 42 or by equivalent devices. The presence of pin 42 allows pressure to build on seated ball 10 in the FIG. 1 position to operate some downhole tool (not shown) such as a packer or liner hanger, for example. If pressure on ball 10 exceeds a predetermined value, which happens after some other tool is actuated, then the shear pin 42 breaks and the ring 22 moves down taking with it sleeves 24 and 32, as shown in the FIG. 2 position. This movement puts collet heads 14 in recess 44 letting loose the grip on ball 10. Sleeve 32 has a series of elongated openings 46 that now straddle port 26 while seals 28 and 30 on sleeve 24 are well below port 26. Reduced diameter 38 is defined by sleeve segments that surround the elongated openings 46 to allow in FIG. 2 the sleeve 32 to now provide support for collet heads 36. Those skilled in the art will appreciate that collet heads 36 allowed ball 10 to pass in the FIG. 1 position are, in the FIG. 2 position able to catch another ball 48, shown in FIG. 3, that is the same size or smaller than ball 10. Thus far, in FIGS. 1 and 2, a downhole tool has been operated and the circulation valve has been opened while the ball 10 has been released from collet heads 14. The shifting of the assembly 20 has also now provided support to collet heads 36 so that they can receive a ball of a size they formerly let pass.

Figure 3:
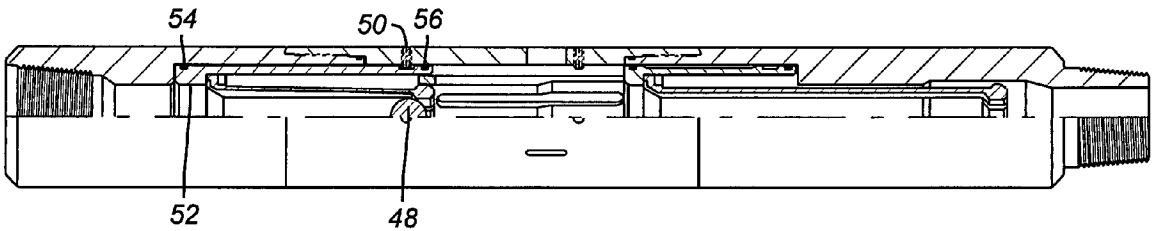
FIG. 3 is the view of FIG. 2 with the second ball landed on the second seat.
Figure 4:
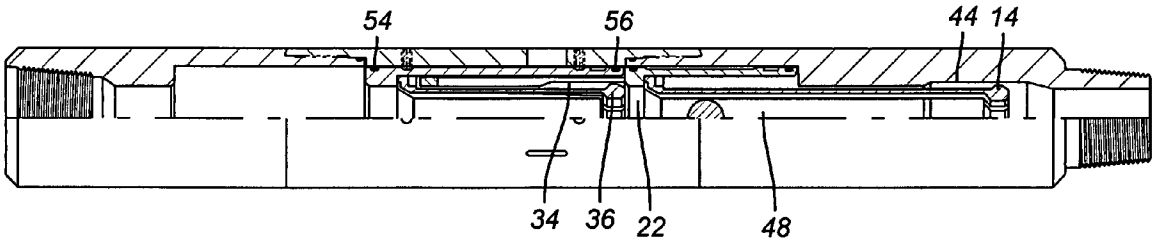
FIG. 4 is the view of FIG. 3 with the second seat shifted, releasing the second ball and the port closed.

FIG. 3 shows a ball 48 landed on collet heads 36 so that pressure can now be built up on ball 48 to break shear pin or equivalent 50, after actuating some downhole tool, so that piston 52 with seals 54 and 56 can slide down to the FIG. 4 position until it butts up against ring 22, which at this point is stationary. FIG. 4 shows the seals 54 and 56 straddling port 26 so as to close it off because piston 52 is a solid sleeve. Furthermore, collet heads 36 have been moved down with piston 52 due to pressure on ball 48 so that they are now in alignment with larger diameter surface 34 once again as they were in FIG. 1. Now the ball 48 can pass by collet heads 36 as well as collet heads 14 now unsupported because of their alignment with groove 44.

The motions that a single modular housing 40 can undergo have been illustrated in the context of a circulation valve. A bottom hole assembly can employ multiple modules that work identically as circulation valves but are deployed at different depths. Alternatively, a single module can also comprise sufficient components to open and close a circulation port more than once. In yet another variation the module can accomplish other downhole operations rather than opening or closing a valve. The pressure operation made possible by the device can also simply allow other tools to be operated with a series of objects that do not need to be successively larger as has been the case in the prior art. Indeed, the modular housing 40 does not need to have a port such as 26 if it is not being used as a circulation valve.

There are many unique features of the present invention that should be mentioned. One is that successive objects, preferably spheres, can be used in succession where subsequent objects are no larger than the previously inserted objects. The release of one inserted object sets up the receipt of another no larger object on a different seat. That seat can subsequently release the later inserted object. The multiple seats allow operations of various tools and no significant drift restriction after the inserted objects are passed by the device. Apart from letting other downhole tools be operated in a desired sequence, the shifting or loss of support for the seats can also be deployed to operate a circulation valve or yet other tools whose operation can be wholly independent of the pressurization function on the seated balls.

Yet another optional feature of the present invention is that collet fingers 18 down to heads 14 can be lined with a material that stretches and is compatible with downhole conditions. This material can be in the form of a sleeve 60 that is secured to the inside of the collet fingers to effectively block the spaces between fingers 18 thus acting as a debris barrier. It can be preferably made of rubber but other materials compatible with downhole conditions can be used. It can be a solid sleeve or a coating on the inside surfaces of the collet fingers or any condition in between. The material 60 can go down to the collet heads 14 so that when the ball 10 arrives, it seals against the material as opposed to a line contact on the sphere 10 with the associated collet heads 14. Similarly, the same treatment can be applied using the material 64 on collet fingers 62 and on down to the associated collet heads 36. The function and operation is the same as described above.

The above description is illustrative of the preferred embodiment and many modifications may be made by those skilled in the art without departing from the invention whose scope is to be determined from the literal and equivalent scope of the claims below.

We claim:

1. A downhole tool, comprising:

a housing comprising at least two seats for sequential pressurization of said housing for operation of at least one tool downhole using at least a first and a second objects where the size of at least the second object is no larger than said first object and said first object lands only on a first seat that is discrete from a second seat on which only a second object lands.

2. The tool of claim 1, wherein:

the size of one of said seats is changeable so that one of said seats will engage an object up to a size that the one of said seats has allowed to pass.

3. The tool of claim 1, wherein:

said housing comprises a plurality of said housings placed in discrete locations on a tubular string.

4. The tool of claim 1, wherein:

said seats comprise an uphole and a downhole seat said second object that lands on said uphole seat is smaller than the first that lands on said downhole seat.

5. A downhole tool, comprising:

a housing comprising at least two seats for sequential pressurization of said housing for operation of at least one tool downhole using at least a first and a second objects in sealing contact with at least one of said seats where the size of at least the second object is no larger than said first object;

the size of one of said seats is changeable so that the one of said seats will engage one of said first and second objects up to a size that the one of said seats has allowed to pass;

movement of the downhole one of said seats with one of said first and second objects landed on the downhole one of said seats makes another seat uphole from the downhole one of said seats change to a smaller dimension.

6. The tool of claim 5, wherein:

said seat situated uphole can move to increase in size to release one of said first and second objects landed on said seat situated uphole.

7. The tool of claim 5, wherein:

movement of the downhole seat releases the object previously supported by the downhole seat.

8. A downhole tool, comprising:

a housing comprising at least two seats for sequential pressurization of said housing for operation of at least one tool downhole using at least a first and a second objects where the size of at least the second object is no larger than said first object;

the size of one of said seats is changeable so that one of said seats will engage one of said first and second objects up to a size that the one of said seats has allowed to pass;

movement of the downhole one of said seats with one of said first and second objects landed on the downhole one of said seats makes another seat uphole from the downhole one of said seats change to a smaller dimension;

said uphole seat comprises a plurality of collets selectively supported by a sleeve movable in tandem with said downhole seat.

9. The tool of claim 8, wherein:

said downhole seat comprises a plurality of collets selectively supported by the internal configuration of said housing.

10. The tool of claim 9, wherein:

said collets defining said downhole seat are connected to a first component of said sleeve that selectively supports the collets defining said uphole seat, by virtue of an overlapping relation with said collets defining said uphole seat, where said first sleeve has differing dimensions.

11. The tool of claim 10, wherein:

said sleeve further comprises a second component to selectively block a port in said housing.

12. The tool of claim 11, wherein:

said second component is solid with spaced seals to straddle said port in said housing when said collets of said downhole seat are supported by said housing.

13. The tool of claim 12, wherein:

said first component of said sleeve further comprises at least one opening to allow flow communication through said port when aligned with said port.

14. The tool of claim 13, wherein:

said second component moves in tandem with said collets defining said downhole seat to align said opening with said port, to release the object from said downhole seat and to support said collets defining said uphole seat.

15. The tool of claim 14, wherein:

said collets defining said uphole seat further comprise an outer sleeve movable with said collets that define said uphole seat to block said port in said housing.

16. The tool of claim 15, wherein:

said outer sleeve movable with said collets defining said uphole seat in tandem and relative to said first component of said sleeve so as to block said port in said housing while aligning said collets defining said uphole seat with the larger dimension of said first component of said sleeve so as to allow an object to pass said uphole seat as well.

17. The tool of claim 9, wherein:

at least one of said plurality of collets further comprises fingers terminating in heads that define a respective seat and a material attached to at least one of said fingers and heads for contact with a delivered object.

18. The tool of claim 17, wherein:

said material comprises a sleeve to block openings among said fingers.

19. The tool of claim 17, wherein:

said material provides a wider contact area on said heads for the object than a line contact.

20. The tool of claim 17, wherein:

said material is resilient to allow said material to move with said fingers or heads.

* * * * *